US005184483A

United States Patent [19]

Conti

[11] Patent Number: 5,184,483

[45] Date of Patent: Feb. 9, 1993

[54] DEVICE WITH A DOUBLE SERIES OF SINKERS AND DOUBLE SINKERS HOUSING FOR MAKING TERRY FABRIC ON RECIPROCATING CIRCULAR MACHINES

[75] Inventor: Paolo Conti, Florence, Italy

[73] Assignee: Conti Florentia S.r.l., Firenze, Italy

[21] Appl. No.: 746,421

[22] Filed: Aug. 16, 1991

[30] Foreign Application Priority Data

Aug. 23, 1990 [IT] Italy ..... 9473 A/90

[51] Int. Cl.[5] ..... D04B 9/42

[52] U.S. Cl. ..... 66/93; 66/217

[58] Field of Search ..... 66/93, 217

[56] References Cited

U.S. PATENT DOCUMENTS

| | | | |
|---|---|---|---|
| 3,293,887 | 12/1966 | Crawford | 66/93 |
| 3,877,258 | 4/1975 | Uhlir | 66/93 |
| 3,937,037 | 2/1976 | Moody | 66/93 |
| 4,041,735 | 8/1977 | Holder | 66/93 X |
| 4,535,608 | 8/1985 | Plath et al. | 66/93 X |
| 4,665,718 | 5/1987 | Jelinek et al. | 66/93 X |
| 4,955,211 | 9/1990 | Hemer | 66/93 X |
| 4,989,421 | 2/1991 | Schmidt | 66/93 X |

FOREIGN PATENT DOCUMENTS

| | | | |
|---|---|---|---|
| 407136 | 3/1934 | United Kingdom | 66/217 |
| 582736 | 11/1946 | United Kingdom | 66/93 |

*Primary Examiner*—Andrew M. Falik
*Assistant Examiner*—John J. Calvert
*Attorney, Agent, or Firm*—McGlew and Tuttle

[57] ABSTRACT

A device for forming, terry knit with a terry yarn and a base yarn for the base fabric. A needle cylinder is provided including a plurality of needles, driven for reciprocating motion. A plurality of sinkers with a high nose for the terry yarn and a plurality of sinkers with a low nose for the base yarn are provided. A high yarn guide for the terry yarn, is provided at a high yarn guide level and a lower yarn guide for the base yarn is provided at a lower level than a level of a surface of the high-nosed sinkers. A fixed annular sinkers housing is provided including a fixed cam profile to control radial movement of the high-nosed sinkers. The cam profile has an area of centrifugal retraction substantially symmetrical with respect to a feeding position of the high yarn guide and the lower yarn guide. An angularly mobile annular sinkers housing is provided for controlling radial movement of the low-nosed sinkers. The angularly mobile annular sinkers housing included a fixed cam having an apex pointing outwardly with respect to the needle cylinder. The angularly mobile annular sinkers housing alternates with each reversal of motion of the needle cylinder such that the fixed cam moves between a first position and a second position. The first position and the second position are substantially symmetrical, with respect to the cam profile, on opposite sides of the high yarn guide and the lower yarn guide for centrifugally retracting low-nosed sinkers in proximity to a stitch forming area, after the feeding position of the high yarn guide and the lower yarn guide, upon each reversal of motion of said needle cylinder.

5 Claims, 5 Drawing Sheets

Fig.7
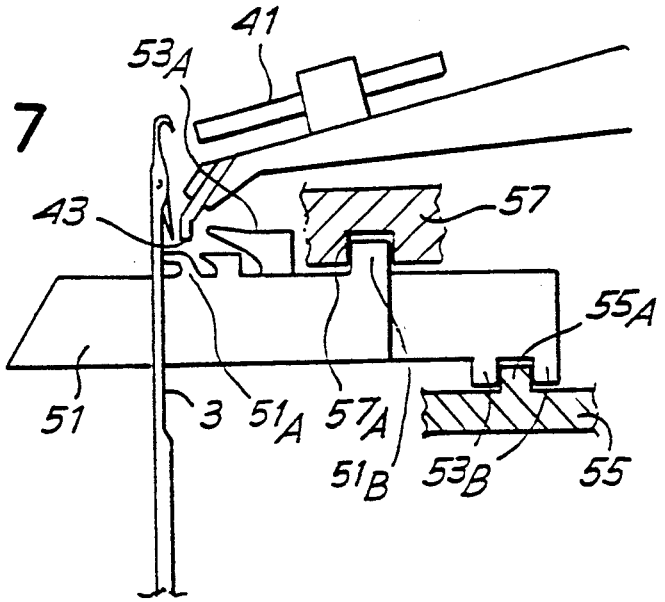
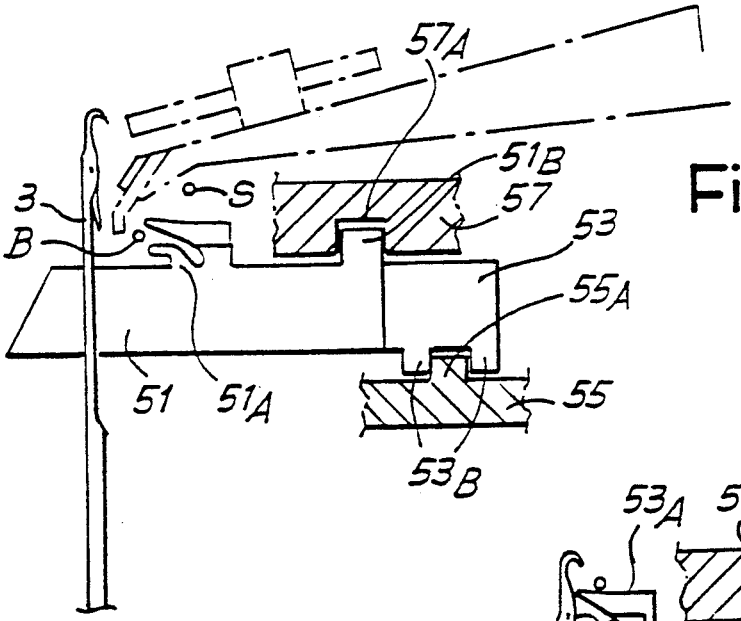
Fig.8
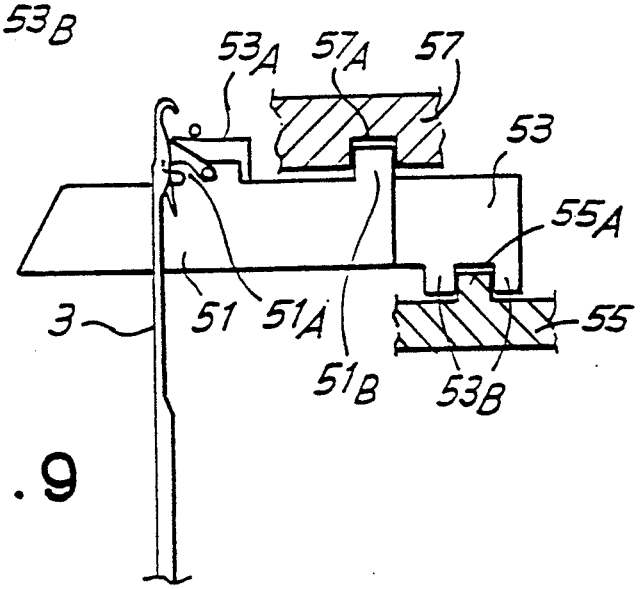
Fig.9

DEVICE WITH A DOUBLE SERIES OF SINKERS AND DOUBLE SINKERS HOUSING FOR MAKING TERRY FABRIC ON RECIPROCATING CIRCULAR MACHINES

FIELD AND BACKGROUND OF THE INVENTION

The invention relates to an improved device for forming terry knit fabric on circular knitting machines, especially—though not exclusively—for socks and the like. The device allows manufactures to be formed with reciprocating motion. These and other aims and advantages will become clear from the following text.

SUMMARY AND OBJECTS OF THE INVENTION

The device in question, for forming, even with recriprocating motion, terry knit with a terry yarn for the eyelets or loops of the terry fabric and a base yarn for the base fabric, comprises in combination:

in the ring of the needle cylinder, sinkers of two types: a sinker with a high nose for the terry yarn, and a sinker with a low nose for the base yarn;

at least one high yarn guide for the terry yarn and at least one lower yarn guide for the base yarn, at a lower level than the level of the surface of the nose of the high-nosed sinker;

a fixed annular sinkers housing with a cam profile to control the radial movements of the high-nosed sinkers, said cam profile having an area of centrifugal retraction that is substantially symmetrical with respect to the feeding position of the yarn guides;

an angularly mobile annular sinkers housing to control the radial movements of the low-nosed sinkers, with a cam having an apex pointing outward, which alternates—with each reversal of the motion of the needle cylinder—between two positions that are substantially symmetrical on opposite sides with respect to the feeding position of the yarn guides, in order centrifugally to retract the low-nosed sinkers each time in proximity to the stitch-forming area, occurring after the feeding position.

A low-nosed sinker and a high-nosed sinker are in practice received in one and the same radial trick.

Advantageously the lower yarn guide for the base yarn is also centripetally further forward than the yarn guide of the terry yarn.

The device may comprise means for imposing the reciprocating angular movement of the mobile sinkers housing for the sinkers intended for the base yarn.

The two types of yarn guides are arranged symmetrically with respect to the path of the higher-nosed sinkers, and the yarn guide for the base yarn is lower than the resting surface of the sinkers for the terry yarn, as a result of which the yarn of said yarn guide is drawn only by the nose of the lower-nosed sinker.

BRIEF DESCRIPTION OF THE DRAWINGS

The invention will be more clearly understood on following the description and attached drawing, which latter shows a practical and non-limiting illustrative embodiment of said invention. In the drawing:

FIGS. 7, 8 and 9 show simplified cross-sections through VII—VII, VIII—VIII and IX—IX of FIG. 5;

DETAILED DESCRIPTION OF THE PREFERRED EMBODIMENT

Figure 1:
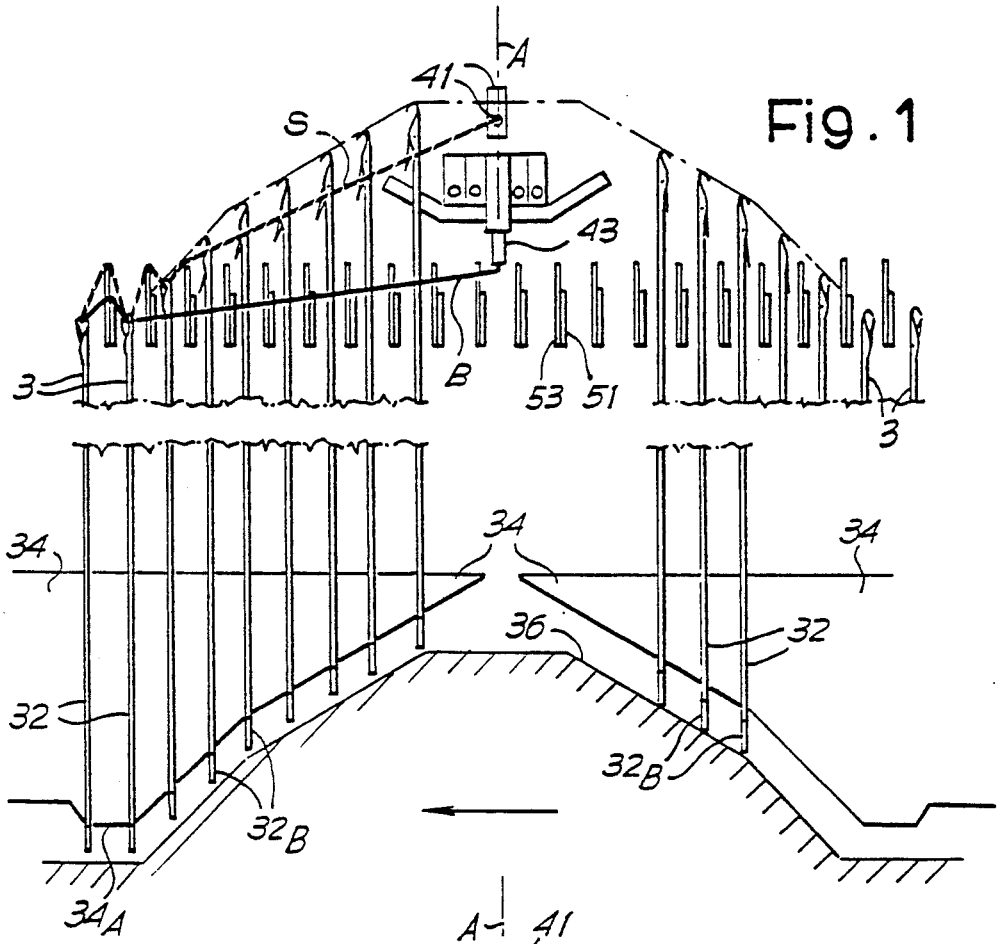
FIGS. 1 and 2 show a diagrammatic view to demonstrate the shape of the cams and the downward movement of the needles in both directions of rotation of the needle cylinder.
Figure 2:
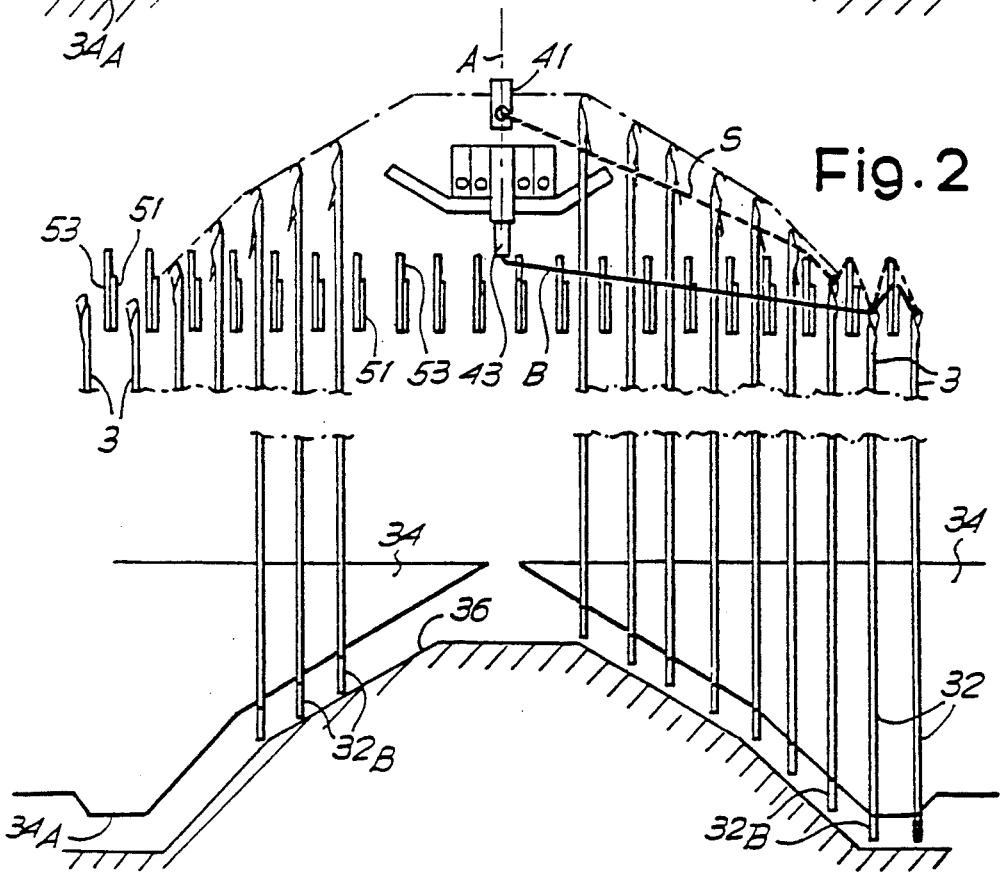
Figure 3:
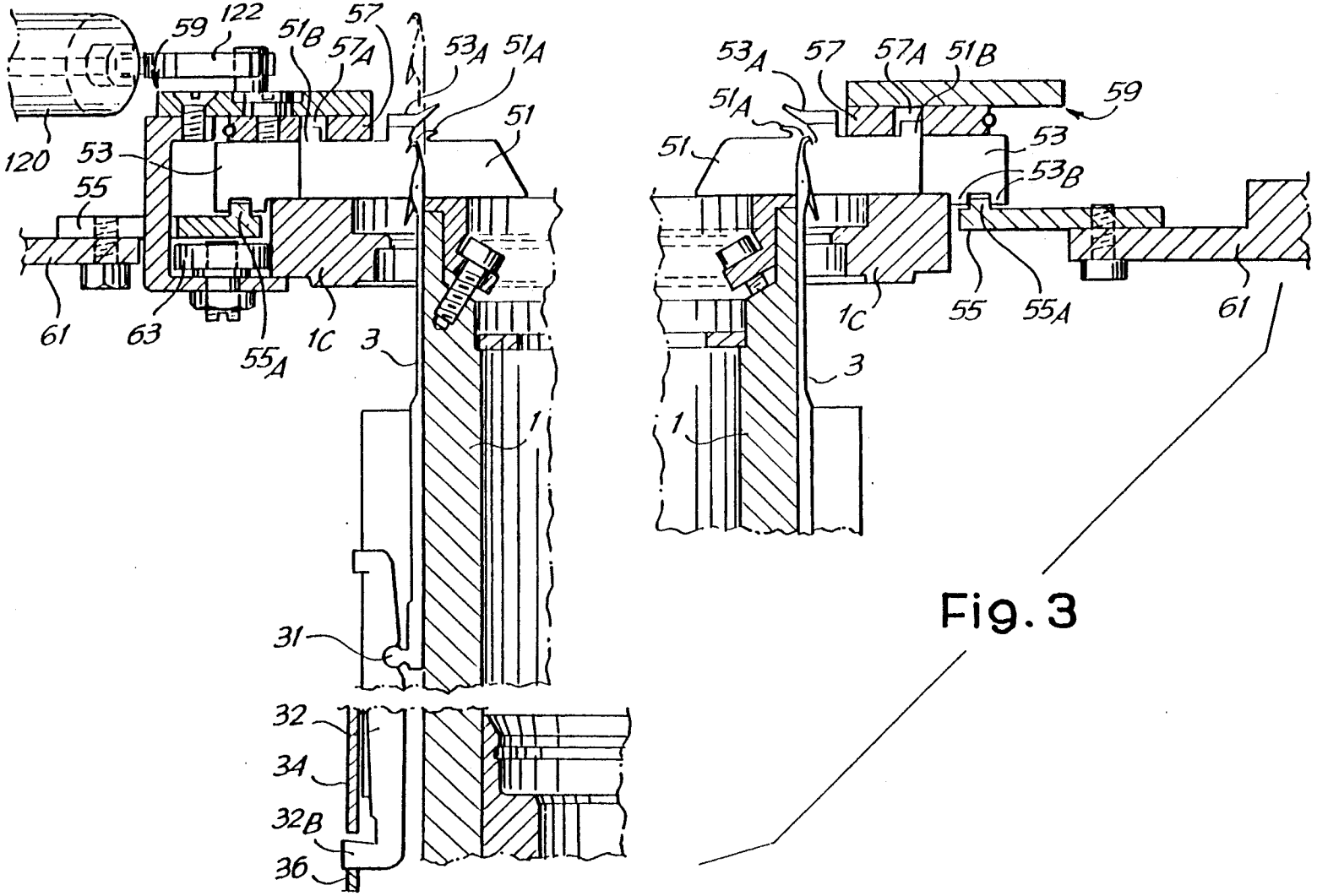
FIG. 3 is a partial radial diagrammatic cross-section in a plane passing diametrically through the axis of the needle cylinder.

In the form illustrated in the attached drawing, 1 indicates in a general way the needle cylinder, with the needles 3 sliding in its longitudinal tricks. To form the terry fabric, these needles 3 can be worked in both directions of motion, up and down. In the example, the needles 3 are worked—via rocking jacks 32 articulated to the needles 3 at a pivot 31—by cams which lower the needles, that is stitch-forming cams 34, which are fixed; these cams 34 are symmetrical with respect to the corresponding yarn feeding position indicated generally by A, in order to work with reciprocating motion. The cams 34 have a lower edge 34A for maximum needle lowering, achieved by acting on the butts 32B of the oscillating jacks 32. In order to lift the needles at each feeder, such as A, a cam indicated by 36 is provided—symmetrical, in the example—which likewise acts on the butts 32B. The oscillating jacks 32 can be controlled—for other selections—by other cams (not shown) which act on further butts on the same jacks 32.

41 indicates a yarn guide, present in each of the feeders that are to supply terry yarn S; the yarn guide 41 is in a relatively high position, to supply the terry yarn S. 43 indicates a yarn guide for the base yarn B, intended to form the basis of the fabric; this yarn guide 43 is lower than the yarn guide 41 and is also closer to the needles than is the yarn guide 41, which yarn guide 41 is in contrast slightly radially retracted in the centrifugal direction, that is further from the needles than the yarn guide 43.

Figure 10:
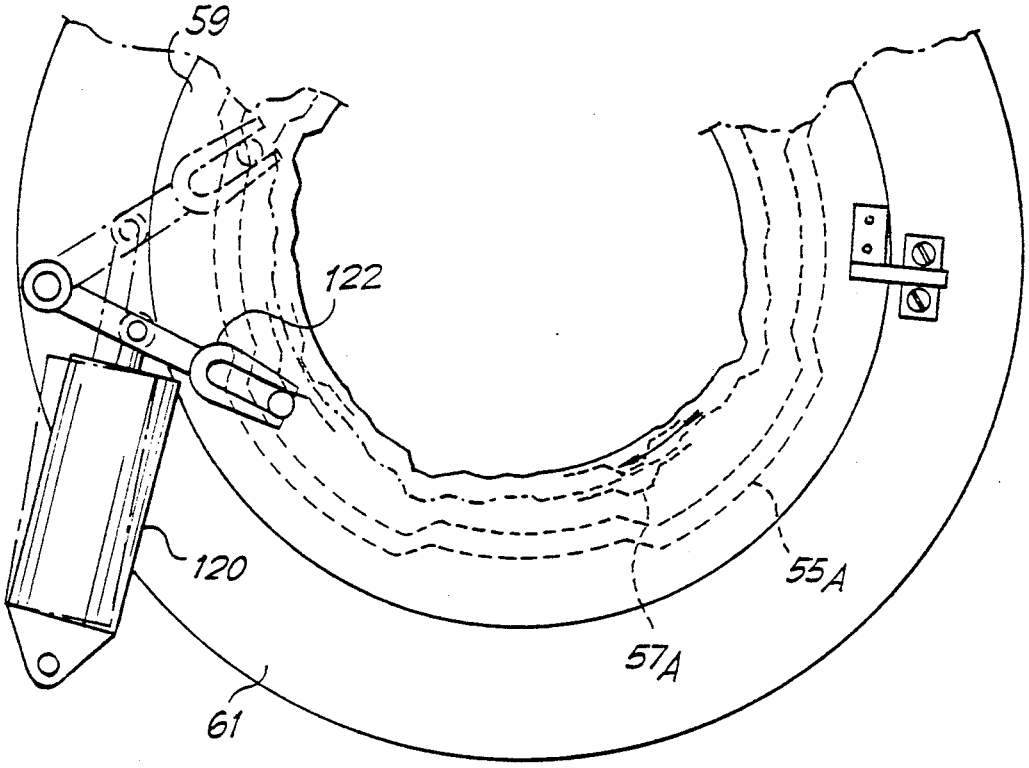
FIG. 10 shows a diagrammatic plan view of the housings of the sinkers.

As the needles 3 are lowered, they engage the yarns S and B and lay them over different sinkers, to create the terry, in relation to the position of the corresponding yarn guides and to the radial position imposed on the sinkers to form the stitch with the yarn B and consequently to form the structure of the base fabric T, while the terry yarn S forms the terry loops CS, shown in FIG. 10.

To create the terry loops CS, the terry yarn S must be held by the sinkers belonging to it so that they lie in a higher position than is offered to the base yarn B by the sinkers belonging to it. To this end, in the ring 1C, which is fixed to the top of the needle cylinder 1 and in which are formed the radial tricks for the sinkers, two kinds of sinkers are provided which can be received in pairs in each individual trick. One kind of sinker, indicated by 51, for the yarn B has a relatively low nose 51A and a control butt 51B. Another kind of sinker 53 for the yarn S which is longer than that 51, has a higher nose that forms a relatively high support surface 53A for the terry yarn S intended to form the terry loops CS, said surface 53 being higher than the yarn guide 43; and the sinkers 53 have a pair of butts 53B defining a recess for their control.

Figure 4:
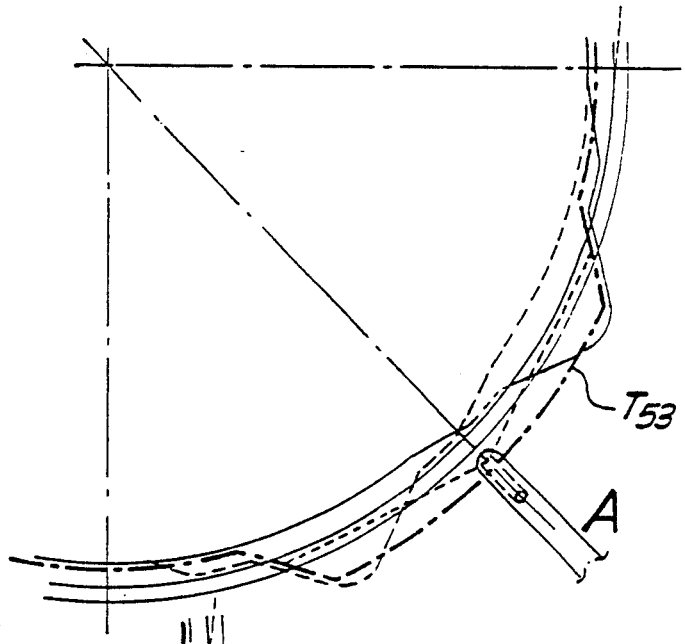
FIGS. 4, 5 and 6 show diagrams of the paths of both kinds of sinkers, in both directions of rotation of the needle cylinder.
Figure 5:
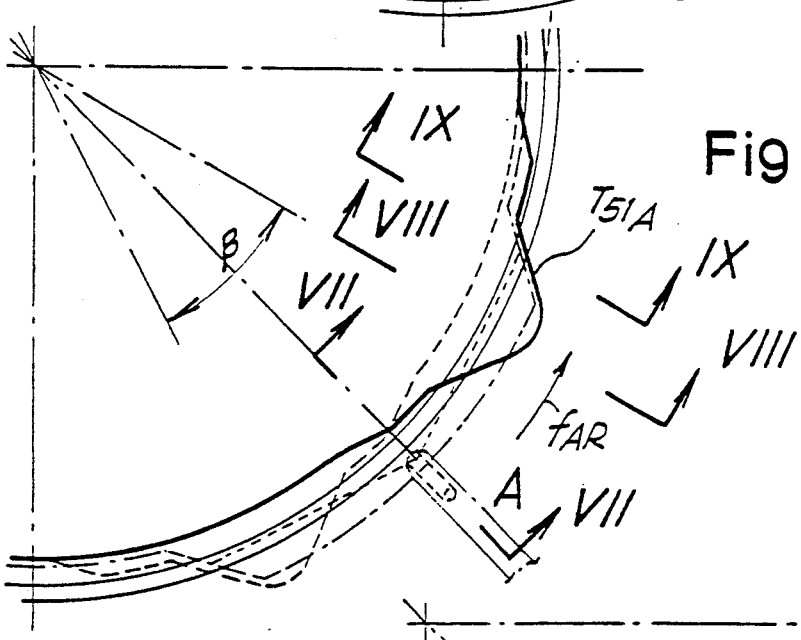
Figure 6:
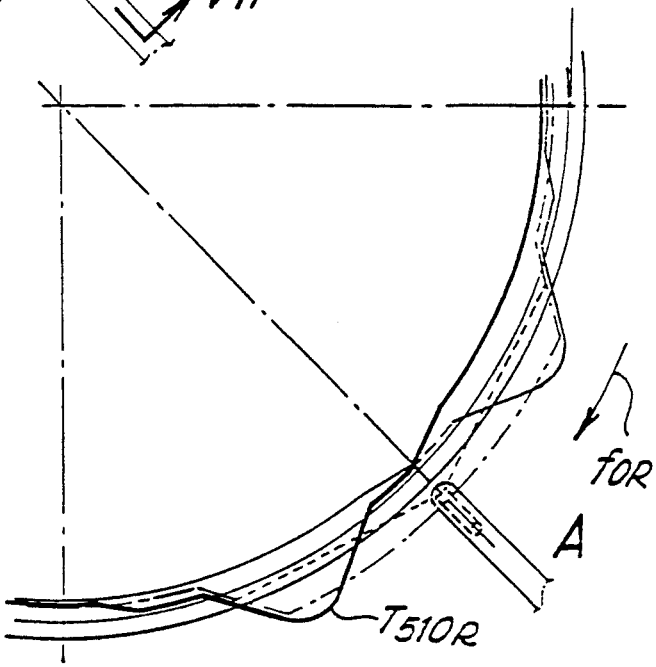

The sinkers 53 execute a radial movement along a fixed path T53 (FIG. 4), at each of the feeders such as that indicated by A in the drawing; this radial movement is symmetrical with respect to said feeding position and constant whatever the direction of rotation of the needle cylinder. In contrast, the sinkers 51 are intended to be so controlled as to execute two different paths in mirror symmetry with respect to the position A of the feeder, depending on the direction of movement of the needle cylinder. In particular in FIG. 5 the counter clockwise direction of rotation fAR of the needle cylinder is indicated and a line T51A shows the path of the sinkers 51 when the direction of rotation is counter clockwise as mentioned above, indicated by the arrow fAR. FIG. 6 indicates the clockwise direction of rotation fOR of the needle cylinder, and T51OR shows the relevant path of the sinkers 51 in said direction of rotation fOR of the needle cylinder.

The sinkers 53 are controlled by a fixed sinkers housing 55 that has an annular cam in the form of a projecting rib indicated by 55A, which cam acts between the two butts 53B of said sinker. In contrast, the sinkers 51, which must be moved alternately along the two paths T51A and T51OR, must be controlled by a mobile sinkers housing that carries a cam 57 forming a channel 57A for the butts 51B; this cam 57 is fixed to an annular sinkers housing structure 59 that is angularly mobile with respect to a fixed structure 61 that carries the cam profile 55; said sinkers housing 59 is guided by centering rollers 63 on the ring 1C of the needle cylinder 1, and can be drawn by the needle cylinder, with each reversal of its rotational motion, over an angle B, or preferably is positively moved into the two positions by a cylinder-piston system 120 and by a fork 122 which compels the sinkers housing 59 to make said stroke. The channel 57A of the cam 57 for the sinkers 51 is shaped symmetrically with respect to an apex as is picked out by the paths T51A and T51OR and can be moved into the two positions shown in FIG. 5 and FIG. 6, symmetrically with respect to the feeding position A. At each reversal of the alternating angular movement of the needle cylinder in the directions of the arrows fAR and fOR, the sinkers housing 59 is simultaneously moved, being guided by the rollers 63, so as to give the two different paths T51A and T51OR of the sinkers 51. In both the directions of rotation of the needle cylinder, the cam 55—which is rib-shaped—always works the sinkers 53 in the same way indicated by the profile T53 shown in FIG. 4 which is symmetrical with respect to the position of the feeder A. The sinkers 51 and 53 are worked radially along the abovementioned paths T51OR, T51AR and T53. The same arrangement is repeated for all the feeders. The yarn guides 41 and 43 feed the yarns S and B at two different levels and with a slight amount of radial offset, as already stated.

Figure 11:
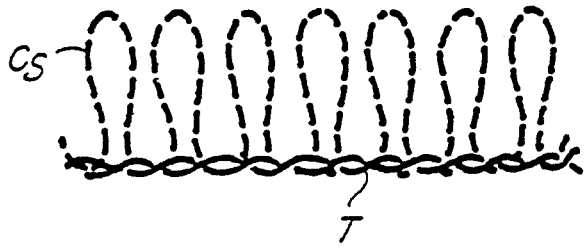
FIG. 11 concisely shows a terry fabric.

It follows from what has been described that the device according to the invention enables a terry fabric to be produced with the needle cylinder that moves alternately in both directions of rotation and with the pairs of sinkers 53 and 51. The yarn S for the terry lies on the surfaces 53A and the sinkers 53, while the yarn B positions itself in front of the nose 51A of the sinkers 51. As the sinkers advance centripetally and the needles 3 move down (under the control of one or other of the cams 34) the yarn S is formed into the loops CS owing to the higher support offered by the surfaces 53A of the sinkers 53, while the yarn B, which rests only on the sinkers 51, and the yarn S are formed into the base fabric T, on which the terry loops CS stand up (FIG. 11).

It will be understood that the drawing shows only an illustrative embodiment which is given purely as a practical demonstration of the invention, it being possible for said invention to vary as regards shapes and arrangements without thereby departing from the scope of the concept underlying said invention. Any reference numbers appearing in the accompanying claims are intended to facilitate the reading of the claims with reference to the description and drawing, and do not limit the scope of protection represented by the claims.

I claim:

1. A device for forming, terry knit with a terry yarn of cotton fiber or other fiber for eyelets or loops of the terry fabric and a base yarn of synthetic fiber or other fiber for the base fabric, comprising:

a needle cylinder including a plurality of needles, said needles cylinder being driven for reciprocating motion;

a plurality of sinkers with a high nose for the terry yarn;

a plurality of sinkers with a low nose for the base yarn;

at least one high yarn guide for the terry yarn, said lower yarn guide being provided at a high yarn guide level;

at least one lower yarn guide for the base yarn, said lower yarn guide being provided at a lower level than a level of a surface of said high-nosed sinkers;

a fixed annular sinkers housing including a cam profile to control radial movement of said high-nosed sinkers, said cam profile having an area of centrifugal retraction substantially symmetrical with respect to a feeding position of said at least one high yarn guide and said at least one lower yarn guide; and an angularly mobile annular sinkers housing for controlling radial movement of said low-nosed sinkers, said angularly mobile annular sinkers housing including a cam fixed with respect to said angularly mobile annular sinkers housing and having an apex pointing outwardly with respect to said needle cylinder, said angularly mobile annular sinkers housing alternating with each reversal of motion of said needle cylinder, such that the fixed cam moves with the annular sinkers housing between a first position and a second position, said first position and said second position being substantially symmetrical, with respect to a contour of said cam, on opposite sides with respect to feeding positions of said at least one high yarn guide and said at least on lower yarn guide for centrifugally retracting low-nosed sinkers in proximity to a stitch forming area, after said feeding position of said at least one high yarn guide and said at least one lower yarn guide, upon each reversal of motion of said needle cylinder.

2. A device according to claim 1, wherein a low-nosed sinker of said plurality of low-nosed sinkers and a high-nosed sinker of said plurality of high-nosed sinkers are each provided in a single radial trick.

3. A device according to claim 1, wherein said at least one lower yarn guide is positioned centripetally further forward than said at least one high yarn guide.

4. A device according to claim 1, further comprising means for imposing alternating angular movement to said angularly mobile annular sinkers housing for sinkers intended to engage the base yarn.

5. A device for forming, terry knit with a terry yarn for loops of the terry fabric and a base yarn for the base fabric, comprising:

a needle cylinder including a plurality of needles, said needles cylinder being driven for reciprocating motion;

a plurality of sinkers with a high nose for the terry yarn;

a plurality of sinkers with a low nose for the base yarn;

at least one high yarn guide for the terry yarn, said high yarn guide being provided at a high yarn guide level;

at least one lower yarn guide for the base yarn, said lower yarn guide being provided at a lower level than a level of a surface of said high-nosed sinkers;

a fixed annular sinkers housing including a fixed cam profile to control radial movement of said high-nosed sinkers, said cam profile having an area of centrifugal retraction substantially symmetrical with respect to a feeding position of said at least one high yarn guide and said at least one lower yarn guide; and an angularly mobile annular sinkers housing for controlling radial movement of said lower-nosed sinkers, said angularly mobile annular sinkers housing including a fixed cam profile having an apex pointing outwardly with respect to said needle cylinder, said angularly mobile annular sinkers housing with said fixed profile alternating with each reversal of motion of said needle cylinder, between a first position and a second position, said first position and said second position positioning said fixed cam profile such that it is substantially symmetrical on opposite sides with respect to feeding positions of said at least one high yarn guide and said at least on lower yarn guide for centrifugally retracting low-nosed sinkers in proximity to a stitch forming area, after said feeding position of said at least one high yarn guide and said at least one lower yarn guide, upon each reversal of motion of said needle cylinder.

* * * * *